United States Patent [19]

Grennan

[11] 4,149,825

[45] Apr. 17, 1979

[54] POWER CONSERVING INDUCER

[75] Inventor: Charles W. Grennan, Newington, Conn.

[73] Assignee: Chandler Evans Inc., West Hartford, Conn.

[21] Appl. No.: 849,554

[22] Filed: Nov. 8, 1977

[51] Int. Cl.[2] ..... F04D 15/00

[52] U.S. Cl. ..... 415/11; 415/46; 415/53 R

[58] Field of Search ..... 415/11, 27, 28, 52, 415/53 R, 46

[56] References Cited

U.S. PATENT DOCUMENTS

| | | | |
|---|---|---|---|
| 2,874,642 | 2/1959 | Forrest | 415/53 |
| 3,504,986 | 4/1970 | Jackson | 415/11 |
| 3,941,498 | 3/1976 | Duckworth et al. | 415/46 |

*Primary Examiner*—Carlton R. Croyle
*Assistant Examiner*—Leonard E. Smith
*Attorney, Agent, or Firm*—Radford W. Luther; Richard A. Dornon

[57] ABSTRACT

An axial inducer, which charges the inlet of a centrifugal impeller has a bypass loop connecting its inlet and outlet. A valve member for controlling bypass flow is positioned in the bypass loop. At low flows, the bypass loop permits the inducer to run closer to design flow conditions than would otherwise be possible and, consequently, generate less pressure rise, consume minimum power, and cause minimal heating of the fluid being pumped. An extension of the bypass valve member functions to restrict the centrifugal pump discharge area when the valve member is positioned to bypass flow to reduce recirculating flow in the centrifugal impeller and increase its efficiency.

4 Claims, 3 Drawing Figures

POWER CONSERVING INDUCER

BACKGROUND OF THE INVENTION

This invention pertains to fluid delivery systems and, more particularly, to high specific speed impeller pumps.

A high specific speed impeller pump such as, for example, an axial inducer, comsumes more power under low or shut-off flow conditions than at design flow conditions. This is attributable to a characteristic pressure rise as the flow decreases below the optimum design flow.

Frequently, in fuel control applications, the pressure rise is far greater than that necessary to properly charge the inlet of the centrifugal pump with which the inducer is associated and consequently the increased power consumption is in no manner beneficial but only occasions an undesirable heating of the fluid being pumped. Since pumped fuel is often used for cooling electronic units, a smaller temperature rise in the pumped fluid enhances the cooling capacity of the fuel. It will also be appreciated that, because of the fact that fuel delivered to the burner nozzles of a gas turbine engine must not exceed a maximum safe temperature, heat rejection to the fuel by the pumping elements should be minimized, particularly if the fuel is used for cooling prior to reaching the pumping elements.

SUMMARY OF THE INVENTION

The invention solves the aforementioned problems by providing a bypass loop in a high specific speed impeller pump whereby the pump can run closer to design flow conditions at low flows therethrough so as to engender minimal heat rejection to the fluid being pumped.

The invention also provides a compact impeller pumping package comprising an axial inducer arranged to charge the inlet of a mixed-flow centrifugal pump with a bypass valve and conduit configuration adapted to direct flow from the inducer outlet to the inducer inlet. The valve member itself may be partially constituted by a cylindrical structure adapted to slide over the shroud of the mixed-flow pump for controlling bypass flow. In addition, the valve member may embody an extension adapted to reduce the mixed-flow pump discharge area when positioned to bypass flow to reduce recirculation losses and thereby increase the efficiency of the mixed-flow centrifugal pump. This problem is discussed in U.S. Pat. No. 3,941,498.

Accordingly, it is a primary object of the invention to provide a means and method for allowing a high specific speed impeller pump to run closer to design flow under no-flow and low-flow conditions.

Another object is to provide a compact pump having an inducer with a flow bypass loop fluidly connecting the inducer outlet to the inducer inlet.

A further object is to provide a pump comprising an axial inducer and a centrifugal impeller with a valve member adapted at low flows to bypass flow around the inducer and to simultaneously restrict the collector inlet area of the centrifugal impeller.

These and other objects and advantages of the invention will become more readily apparent from the following detailed description, when taken in conjunction with the accompanying drawings, in which:

DETAILED DESCRIPTION OF THE PREFERRED EMBODIMENT

Figures 1, 2, 3:
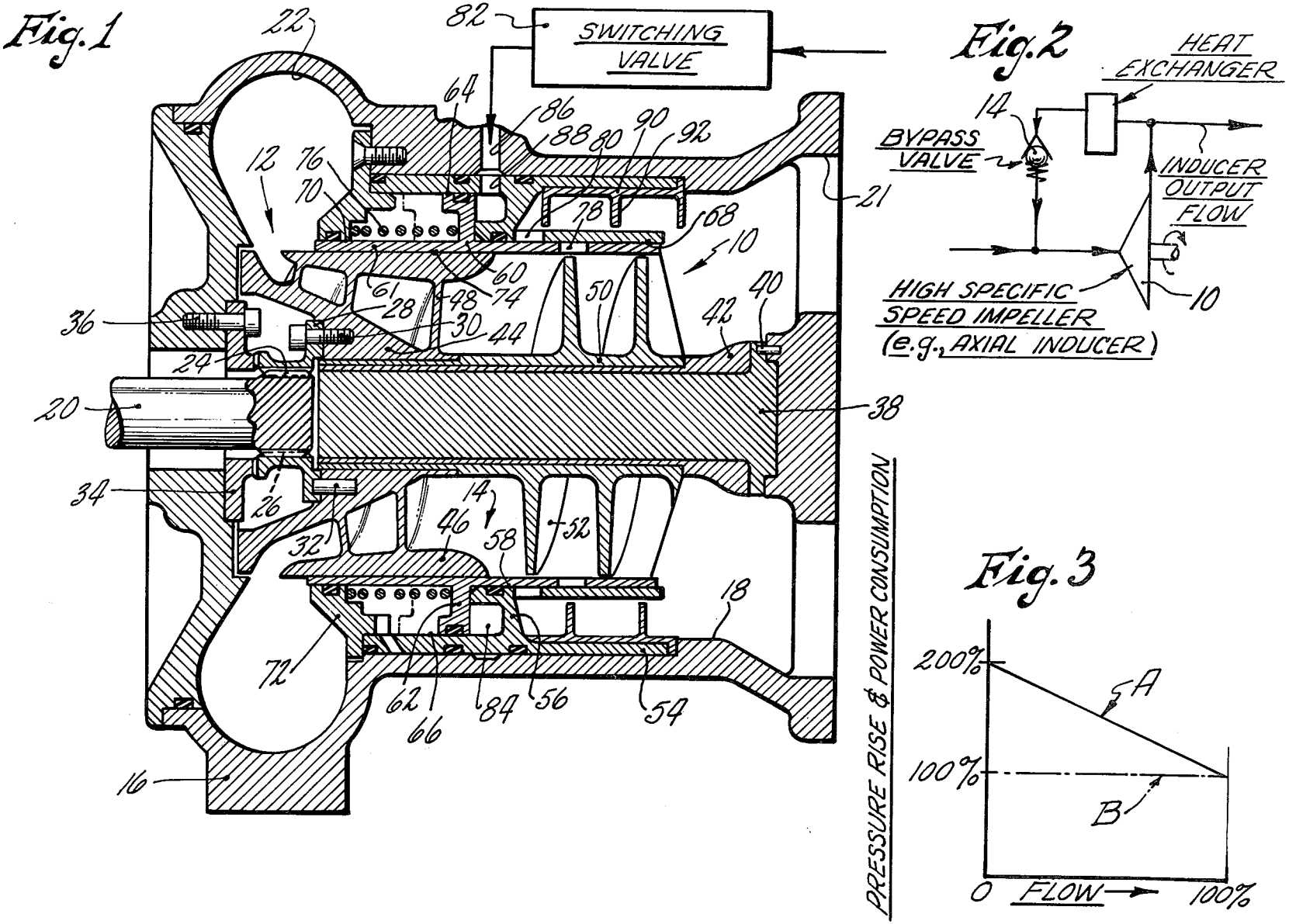
FIG. 1 is a longitudinal sectional view of a pumping system in accordance with the invention.
FIG. 2 is a schematic view of a pumping system of the invention.
FIG. 3 is a graph showing the power consumed by both a typical high specific speed impeller pump and pump according to the invention as a function of fluid flow.

Referring to FIG. 1, there is shown a pumping system of the invention which cmprises a high specific speed impeller in the form of an axial inducer, generally indicated at 10, a centrifugal impeller in the form of a mixed-flow impeller, generally shown at 12, and a bypass valve, generally designated at 14. The elements of the pump are mounted in a housing 16 in such a manner as to provide a compact pump construction.

Extcnding into a pumping cavity 18 in the housing 16 is a drive shaft 20 journaled in suitable bearings (not shown). The pumping cavity 18 has an inlet 21 and a collector 22. The drive shaft 20 may be operatively connected to the gear box of a gas turbine engine as will be appreciated by those skilled in the art. Drive shaft 18 has a plurality of external splines 24 thereupon which are seated in the respective slots between a plurality of internal splines 26 on a drive coupling 28. The drive coupling 28 is fixedly secured to the mixed-flow impeller 12 by means of bolts 30 and pins 32. Forward axial movement of the drive coupling 28 and, hence, the mixed-flow impeller 12 is limited by a bumper 34 attached to the housing 16 by bolts 36. The purpose of such a bumper 34 is to prevent the left end of the mixed-flow impeller 12 from rubbing against the interior housing wall. A post 38 connected to the housing 16 by pins 40 serves to mount a bearing 42 over which the axial inducer 10 is adapted to rotate. It will be appreciated that there is a coaxial relationship between the shaft 20, the bearing 42, and the post 38.

The mixed-flow impeller 12 comprises a hub portion 44, a shroud 46 and the usual spiral blade forming the interconnection therebetween. The axial inducer 10 comprises the usual hub portion 50 which carries a helical blade 52. It will be noted that the hub 44 of the mixed-flow pump 12 is press fitted and pinned over a reduced diameter portion of the inducer hub 50 such that the mixed-flow impeller 12 and the inducer 10 are in effect a unitary structure and are adapted to rotate in unison with the drive shaft 20.

A sleeve 54 is mounted upon an interior cylindrical wall portion of the housing 16. Sleeve 54 is provided with a radially inwardly projecting flange 56 which has an interior cylindrical surface 58. On a cylindrical valve member 60, having a front extension 61, is formed a radially outwardly projecting flange 62 with a cylindrical outer surface 64 in sliding engagement with the interior cylindrical wall 66 of the sleeve 54. The intermediate cylindrical surface 68 of the valve member 60 is in sliding contact with the cylindrical surface 58 to the right of flange 62 and is in sliding contact with the inner cylindrical periphery 70 of a spring seat 72. The inner cylindrical periphery 74 of the valve member 60 slides over the outer surface of the shroud 46. A compression spring 76 is seated against the spring seat 72 and the valve member 60 for urging the latter to the right such that the flange 62 abuts the flange 56. The valve member 60 is provided with a port 78 adapted to communicate with a port 80 in the flange 56 of the sleeve 54 when the valve member 60 is driven to the left for bypassing flow around the axial inducer 10. Such leftward movement also results in a simultaneous reduction in the collector inlet area for reducing recirculation losses in the mixed-flow impeller 12.

A switching valve 82 functions as a valve positioning device and directs a high fluid pressure behind the flange 62 into a variable volume chamber 84 via conduits 86 and 88 in the housing 16 and sleeve 54, respectively, when a parameter of low flow rate, such as a predetermined pressure rise across the entire pump is sensed. As the pressure rise decreases, the switching valve 82 will be repositioned so as to vent the high pressure in the variable volume chamber 84 and allow the valve member 60 to return to the illustrated position whereby flow bypassing ceases.

Yet another sleeve 90 is mounted upon the sleeve 54. Sleeve 90 carries a helical blade 92 which extends from adjacent the port 80 to the inlet of the axial inducer 10. Although such a device is not essential to the invention, it will impart a swirl to the bypasses flow which is desirable because of the momentum thereby imparted to the fluid entering the inducer inlet. This permits a move satisfactory correspondence between the entering flow angle and blade angle at reduced flows.

Viewing the overall pump, fluid enters thereinto through the inlet 21 and proceeds thence to the inlet of inducer 10 where it mixes with the bypassed flow, if any. The axial inducer 10 furnishes the necessary high suction specific speed to maintain operation under high vapor to liquid conditions (should the pumped fluid be fuel) and a limited pressure rise for charging the inlet of the mixed-flow impeller 12 to prevent or minimize cavitation therein. Flow emerging from the mixed flow pump 12 enters the collector 22 and is thence discharged from the housing 16 via a suitable conduit (not shown).

In operation, when the pressure rise across the entire (mixed-flow impeller and axial inducer) pumping system exceeds a predetermined level (which indicates low flow conditions), a signal is applied to switching valve 82 causing high pressure to be delivered to variable volume chamber 84. High pressure in chamber 84 results in valve member 60 being driven forwardly or to the left (indicated in phantom) against the bias of spring 76 until spring 76 is fully compressed. Such action causes ports 78 and 80 to communicate whereby a bypass path is established around the axial inducer 10, thereby allowing the axial inducer to run closer to design flow conditions. In addition, leftward movement of valve member 60 causes extension 61 to cover a portion of the inlet area of the collector 22, whereby recirculation losses in the mixed-flow impeller 12 are ameliorated. In like manner, when the pressure drops below another predetermined level, the high pressure in chamber 84 is vented by the switching valve 82, whereby the valve member 60 returns to its original (illustrated) position in which no flow is being bypassed and the collector inlet is unrestricted.

Alternatively, the switching valve 82 could be omitted and pump discharge pressure could be directly ported behind the flange 62 while the front of the flange was referenced to inducer inlet pressure. The provision of an appropriate spring 76 would then permit reciprocation of the valve member 60 such that a generally constant pressure differential may be maintained across the entire pump.

With reference to FIG. 2, a possible use of the bypass flow is depicted. A heat exchanger could, for example, be inserted in the bypass loop for the cooling of a heat generating device in a manner similar to that shown in U.S. Pat. No. 3,733,816. It will be appreciated that only a limited pressure differential would typically be required for such an application. It would also be possible to provide a filter in the bypass loop for serving as a source of filtered fluid.

The graph of FIG. 3 (line A) shows the relationship between flow and pressure rise and power consumption for a given axial inducer or other high specific speed impeller, without the bypass feature of the invention running at a given RPM. Line B of the same graph indicates a possible relationship between flow and pressure rise when the previously mentioned inducer of line A is provided with a bypass arrangement of the invention.

Obviously, many modifications and variations are possible in light of the above teachings without departing from the scope and spirit of the invention as defined in the appended claims.

What is claimed is:

1. In a method of increasing the efficiency of a high specific speed impeller having an inlet and an outlet under low flow conditions of the type comprising the steps of: sensing a parameter indicative of the flow rate through the high specific speed impeller; and bypassing flow from the high specific speed impeller outlet to the high specific speed impeller inlet when the parameter attains a predetermined valve, the improvement comprising the step of:

imparting a swirl to the fluid as it is being bypassed from the high specific speed impeller outlet to the high specific speed impeller inlet in the direction of rotation of the high specific speed impeller.

2. In a pumping system adapted to produce minimal heating of the fluid being pumped under low flow conditions of the type having: a housing; a high specific speed impeller mounted for rotation in the housing so as to define an inlet and an outlet therefor; a centrifugal impeller mounted in the housing for rotation in tandem relationship to the high specific speed impeller such that an inlet and an outlet for the centrifugal impeller are defined therein, the centrifugal impeller inlet being adjacent the outlet of the high specific speed impeller so as to receive flow therefrom and be charged thereby, the housing having a collector with an inlet formed adjacent the outlet of the centrifugal impeller for receiving flow impelled thereby; a positionable bypass valve for directing flow from the high specific speed impeller outlet to the high specific speed impeller inlet, the bypass valve including a cylindrical valve member mounted in the housing for sliding movement therein; and a valve positioning device for controlling the position of the cylindrical valve member, the improvement comprising:

the centrifugal impeller being a mixed flow impeller and having a shroud with a cylindrical outer periphery, the cylindrical valve member being adapted for sliding movement over the shroud; and the cylindrical valve member comprising an extension adapted to cover a portion of the collector inlet when the bypass valve is positioned to direct flow from the high specific speed impeller outlet to the high specific speed impeller inlet.

3. The improvement of claim 2, wherein the pumping system is of the type further having: means to bias the valve member to a position in which bypass flow is prevented; and means cooperating with the valve member to define a variable volume chamber and wherein the improvement further comprises:

the valve positioning device being constituted by a switching valve adapted to sense a parameter indicative of the flow through the high specific speed impeller and adapted to direct a high fluid pressure to the chamber for moving the valve member against the bias to a position in which bypass flow is permitted.

4. The improvement of claim 2, further comprising: means to impart a swirl to the fluid directed by the bypass valve from the high specific speed impeller outlet to the high specific speed impeller inlet in the direction of rotation of the high specific speed impeller.

* * * * *